US010137705B2

(12) United States Patent
Suzuki

(10) Patent No.: US 10,137,705 B2
(45) Date of Patent: Nov. 27, 2018

(54) TRANSPORT DEVICE AND PRINTING APPARATUS

(71) Applicant: SEIKO EPSON CORPORATION, Tokyo (JP)

(72) Inventor: Junya Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/674,359

(22) Filed: Aug. 10, 2017

(65) Prior Publication Data

US 2018/0056673 A1 Mar. 1, 2018

(30) Foreign Application Priority Data

Aug. 29, 2016 (JP) ..... 2016-166549

(51) Int. Cl.

| | |
|---|---|
| ***B41J 29/12*** | (2006.01) |
| ***B41J 11/00*** | (2006.01) |
| ***B41J 29/02*** | (2006.01) |
| ***B41J 29/13*** | (2006.01) |
| *B41J 13/00* | (2006.01) |
| *B41J 15/04* | (2006.01) |
| *B41J 2/01* | (2006.01) |

(52) U.S. Cl.

CPC ..... *B41J 11/0045* (2013.01); *B41J 11/002* (2013.01); *B41J 29/02* (2013.01); *B41J 29/12* (2013.01); *B41J 29/13* (2013.01); *B41J 2/01* (2013.01); *B41J 13/0009* (2013.01); *B41J 15/04* (2013.01)

(58) Field of Classification Search

CPC ..... B41J 11/0045; B41J 29/12; B41J 15/04; B41J 13/0009; B41J 2/01; B41J 29/13; B41J 29/02; B41J 11/002

See application file for complete search history.

(56) References Cited

U.S. PATENT DOCUMENTS

2013/0286125 A1* 10/2013 Mikuriya ..... B41J 13/106 347/104

FOREIGN PATENT DOCUMENTS

JP 2010-260342 A 11/2010

* cited by examiner

*Primary Examiner* — Yaovi M Ameh
(74) *Attorney, Agent, or Firm* — Workman Nydegger

(57) ABSTRACT

A transport device includes a transport section configured to transport a medium, a medium guide section including a guide face for guiding, in a transport direction, the medium in a state of being transported by the transport section, a cover configured to be attached on the guide face, and a storage section configured to store in itself the cover in a state of being detached, and one edge side of the cover is secured to the storage section.

8 Claims, 6 Drawing Sheets

TRANSPORT DEVICE AND PRINTING APPARATUS

BACKGROUND

1. Technical Field

The present invention relates to a transport device and a printing apparatus.

2. Related Art

Heretofore, in a printing apparatus for printing characters, images, and/or the like on a medium, a transport device for transporting the medium has been provided. For such a transport device, there are some types of transport devices each provided with an attachable/detachable cover for allowing the medium to be transported in a favorable condition. For example, in JP-A-2010-260342, there is disclosed an ink jet printing apparatus (a printing apparatus including a transport device) provided with a platen cover (a cover) configured to adjust friction resistance between a platen and a medium.

Such a cover is attached when needed, for example, in a case where a particular kind of medium is handled. In the printing apparatus including a transport device in JP-A-2010-260342, the cover is configured to be separated from the body of the apparatus when detached, and thus is likely to be lost.

SUMMARY

An advantage of some aspects of the invention is that a transport device and a printing apparatus are provided that enable the prevention of the loss of a cover. The invention can be embodied in the form of application examples and embodiments described below.

Application Example 1

A transport device according to this application example includes a transport section configured to transport a medium, a medium guide section including a guide face for guiding, in a transport direction, the medium in a state of being transported by the transport section, a cover configured to be attached on the guide face, and a storage section configured to store in itself the cover in a state of being detached, and one edge side of the cover is secured to the storage section.

According to this application example, the transport device includes a storage section configured to store a cover therein, and one edge side of the cover is coupled to the storage section. With this configuration, even when the cover is in a state of being detached from the guide face, the cover is coupled to the transport device through the storage section, and thus, the loss of the cover is prevented. Further, the cover is stored in the storage section in the state described above. Accordingly, the provision of a transport device configured to prevent the loss of a cover is achieved.

Application Example 2

In the transport device in application example 1 described above, preferably, the storage section is disposed along an upstream edge side of the guide face, and the other edge side of the cover is configured to be attachably and detachably engaged with a downstream side of the medium guide section through the guide face.

According to this application example, the storage section of the transport device is disposed along the upstream edge side of the guide face. The one edge side of the cover is secured to the storage section, and the other edge side edge of the cover is attachably and detachably engaged with a downstream side of the medium guide section through the guide face. With this configuration, a user is able to easily attach/detach the cover onto/from the guide face.

Application Example 3

In the transport device in each of application examples 1 and 2 described above, preferably, the cover includes a bending property and is deformed so as to follow a surface shape of the guide face.

According to this application example, the cover is deformed so as to follow the surface shape of the guide face, and thus, the cover is closely adhered to the guide face. With this configuration, the transport device transports the medium in a favorable condition.

Application Example 4

In the transport device in each of application examples 1 to 3 described above, preferably, the storage section includes a winding portion including a winding shaft around which the cover is wound.

According to this application example, the storage section includes a winding portion including a winding shaft around which the cover is wound. With this configuration, a use is able to easily store the cover in a state of having been detached into the storage section.

Application Example 5

In the transport device in application example 4 described above, preferably, the winding shaft is configured to extend in a direction intersecting with the transport direction.

According to this application example, the winding shaft extends in a direction intersecting with the transport direction of the medium. With this configuration, a user is able to draw the cover in a state of being wound, from the winding shaft along the transport direction, and thus, the user is able to attach the cover onto the guide face in a favorable manner.

Application Example 6

A printing apparatus according to this application example includes the transport device according to any one of application examples 1 to 5.

According to this application example, the printing apparatus includes the transport device according to any one of application examples 1 to 5 described above, and thus, the provision of a printing apparatus configured to prevent the loss of a cover is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. It should be noted that, in each of figures referred to below, each member or the like is drawn in a scale different from an actual scale to enable the each member or the like to be viewed with its size modified to a recognizable degree of size.

Further, in FIGS. 1 to 10, for the convenience of description, three axes orthogonal to one another, that is, an X-axis, a Y-axis, and a Z-axis, are illustrated, and the direction of each of the axes is denoted by an arrow whose tip side and base side will be respectively referred to as a "+side" and a "−side". A direction parallel to the X-axis, a direction parallel to the Y-axis, and a direction parallel to the Z-axis will be respectively referred to as an "X-axis direction", a "Y-axis direction", and a "Z-axis direction".

Embodiment

A printing apparatus described in this embodiment includes a transport device for transporting a medium. This printing apparatus is, for example, an ink jet printer. In this embodiment, a large format printer (LFP) for handling a relatively large medium (recording medium) is taken as an example for describing the configuration of the printing apparatus.

Figure 1:
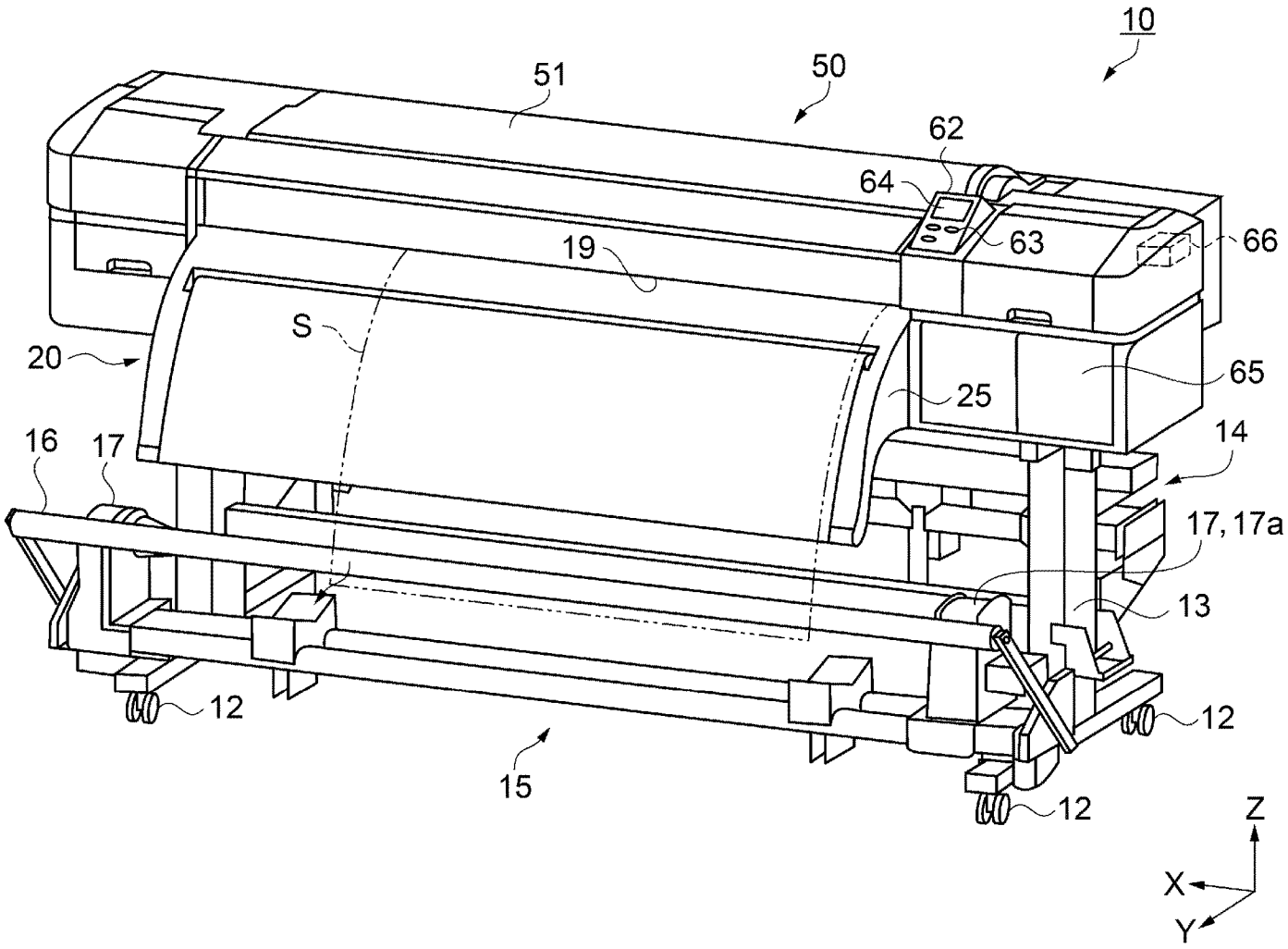
FIG. 1 is a schematic perspective view of a transport device and a printing apparatus including the transport device, both according to an embodiment of the invention, illustrating a configuration of the transport device and the printing apparatus.
Figure 2:
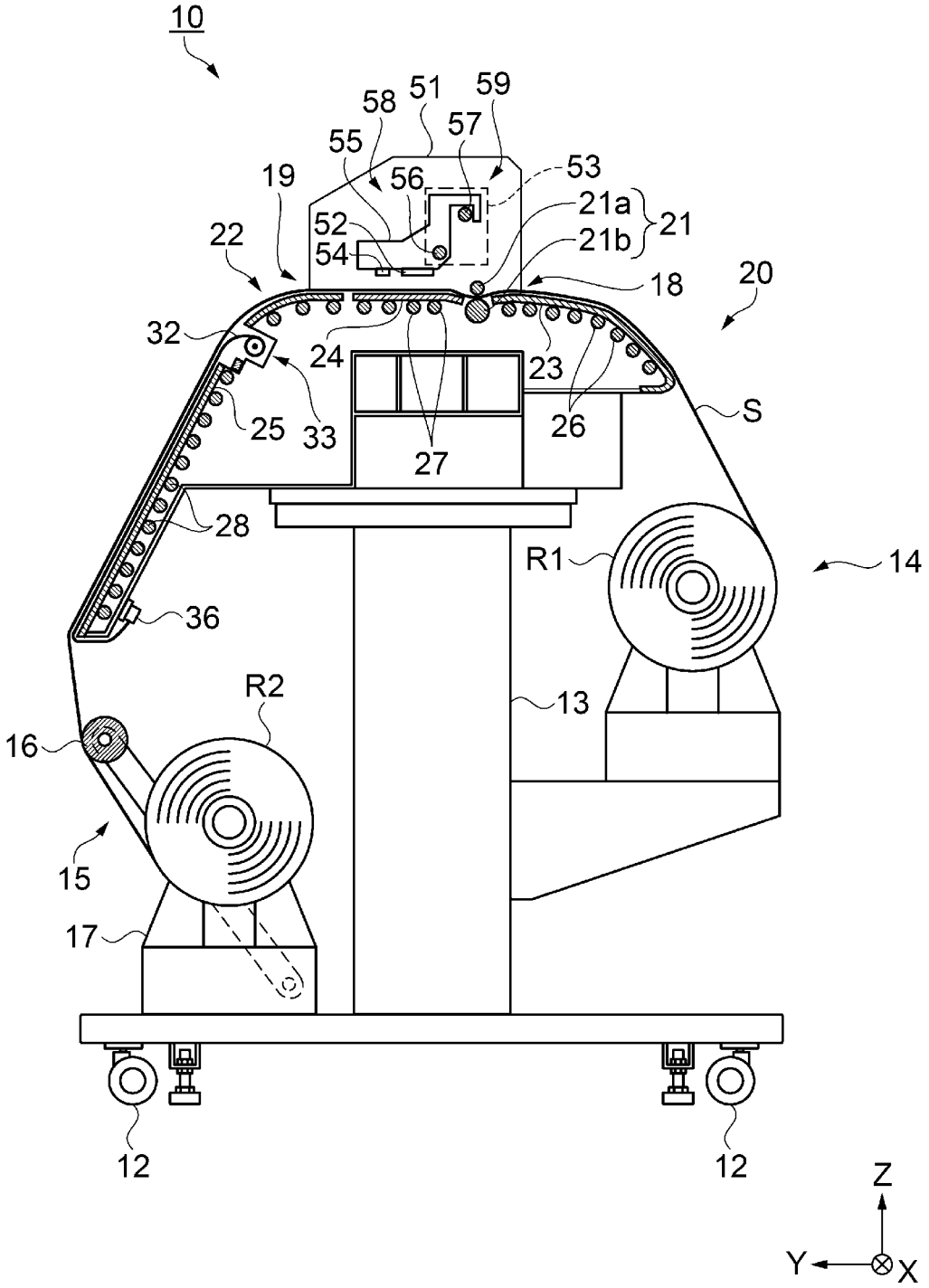
FIG. 2 is a cross sectional view of the transport device and the printing apparatus illustrating an internal configuration of the transport device and the printing apparatus.

FIG. 1 is a schematic perspective view of the transport device and the printing apparatus including the transport device, both according to this embodiment, illustrating the configuration thereof. FIG. 2 is a cross sectional view of the transport device and the printing apparatus illustrating the internal configuration thereof. The configuration of a transport device 20 and a printing apparatus 10 will be described below with reference to FIGS. 1 and 2.

As shown in FIGS. 1 and 2, the printing apparatus 10 includes a medium feeding section 14, a medium winding section 15, the transport device 20, and a printing unit 50. The medium feeding section 14 and the medium winding section 15 supply and collect a medium S by means of a roll-to-roll method. The transport device 20 transports the medium S of a long size in a transport direction. The printing unit 50 performs printing on the medium S. The transport device 20 is supported by a pair of leg portions 13, and wheels 12 are secured to lower end portions of the leg portions 13. The printing unit 50 includes a housing portion 51 and is disposed on the transport device 20. The housing portion 51 is formed in an approximately rectangular solid shape. Note that, in the present embodiment, an upward/downward direction along the gravity direction is associated with the Z-axis, and herein, +Z-axis side is associated with "upward". Further, a long-side direction (a leftward/rightward direction) of the printing unit 50 (the housing portion 51), which is a direction intersecting with the Z-axis direction, is associated with the X-axis, and herein, a "+X-axis side" is associated with "leftward". Moreover, a frontward/backward direction, which is a direction intersecting with both of the Z-axis direction and the X-axis direction, is associated with the Y-axis, and herein, a +Y-axis side is associated with "frontward". Furthermore, positional relations along the transport direction of the medium S are also referred to as "upstream" and "downstream".

The transport device 20 forms a long shape in the X-axis direction, and a medium feeding section 14 is disposed at the −Y-axis side of the pair of leg portions 13, which are disposed at the left and right sides of the transport device 20. The medium feeding section 14 feeds the medium S having a long size and wound in a roll shape toward the transport device 20. Further, the medium winding section 15 is disposed at the +Y-axis side of the pair of legs 13, and winds up the medium S having been fed out from the transport device 20 into a roll shape. In addition, in the printing apparatus 10, as the medium S, for example, a polyvinyl chloride type film having a width of approximately 64 inches is used.

Further, a rolled object R1 is held in the medium feeding section 14, and this rolled object R1 is constituted by the medium S in a state of being not yet used and lap-wound in a cylindrical shape. Further, a plurality of kinds of the rolled objects R1 having a plurality of sizes determined by different widths (X-axis direction lengths) and different total winding numbers of various kinds of the media S are each set into the medium feeding section 14 in a replaceable manner. Further, whichever one of such a plurality of sizes the rolled object R1 has, the rolled object R1 is set in the medium feeding section 14 in a state in which the rolled object R1 is set at a position adjacent to the −X-axis side edge of the medium feeding section 14. Further, the medium feeding section 14, in which the rolled object R1 is set, is rotated in the counterclockwise direction in FIG. 2, thereby causing the medium S to be unwound from the rolled object R1 and be fed toward the transport device 20.

In the medium winding section 15, the medium S having been fed out from the transport device 20 is wound in a cylindrical shape and is formed into a rolled object R2. The medium winding section 15 includes a pair of holders 17. This pair of holders 17 pinches a core member that allows the medium S to be wound around the core member itself so as to be formed into a rolled object. A holder 17*a* among the holders 17 is provided with a winding motor (not illustrated) for applying a rotation force to the core member. The winding motor is driven to rotate the core member, thereby causing the medium S to be wound around the core member so as to be formed into a rolled object R2. The medium winding section 15 includes a tension roller 16. This tension roller 16 presses the reverse face side of the medium S hanging down due to its weight from the transport device 20 to apply a tensile force to the medium S in a state of being wound into the medium winding section 15.

Configuration of Transport Device

The transport device 20 includes a transport roller twin 21 and a medium guide section 22. The transport roller twin 21 serves as a transport section for transporting the medium S, and the medium guide section 22 guides the medium S in a state of being transported by the transport roller twin 21.

The medium guide section 22 is a section for supporting the medium S from below (from the −Z-axis side) in a transport path of the medium S. The medium guide section 22 includes a platen 24, an upstream side guide section 23, and a downstream side guide section 25. The platen 24 is disposed opposite a printing section 58 described below. The upstream side guide section 23 guides the medium S having been fed from the medium feeding section 14 toward the platen 24. The downstream side guide section 25 guides the medium S from the platen 24 toward the medium winding section 15.

The transport device 20 includes a first heater (pre-heater) 26, a second heater (platen heater) 27, and a third heater (after-heater) 28. The first heater 26, the second heater 27, and the third heater 28 heat the medium S. The first heater 26 heats the medium S in a state of being supported by the upstream side guide section 23. The first heater 26 is disposed at the side of a face (−Z-axis side face) opposite a face supporting the medium S in the upstream side guide section 23. The second heater 27 heats the medium S in a region where printing on the medium S is performed. The second heater 27 is disposed at the side of a face (−Z-axis side face) opposite a face supporting the medium S in the platen 24. The third heater 28 is configured to heat the medium S to allow inks to be promptly dried and adhered onto the medium S so as to prevent the occurrence of stains and blurs and thereby increase the quality of an image. The third heater 28 is disposed at the side of a face (−Z-axis side face) opposite a face supporting the medium S in the downstream side guide section 25.

The first heater 26, the second heater 27, and the third heater 28 are, for example, tube heaters, and are respectively bonded to the reverse face of the upstream side guide section 23, the reverse face of the platen 24, and the reverse face of the downstream side guide section 25 through aluminum tapes or the like. Further, the first heater 26, the second heater 27, and the third heater 28 are driven to allow the faces supporting the medium S and constituting the medium guide section 22 to be heated by heat conduction, thereby allowing the medium S to be heated from the reverse side (−Z-axis side) of the medium S. Further, for example, the temperature of heating by the first heater 26 is set to 40° C., and the temperature of heating by the second heater 27 is set to 40° C. (a target temperature). Moreover, the temperature of heating by the third heater 28 is set to 50° C., a temperature higher than those of the first heater 26 and the second heater 27.

The first heater 26 is configured to accelerate the drying of the inks after the landing thereof by gradually heating up the medium S from an ordinary temperature to a target temperature (a temperature at the second heater 27). Further, the second heater 27 is configured to accelerate the drying of the inks after the landing thereof by allowing the medium S to be subjected to the landing of the inks in a state in which the target temperature is kept. Moreover, the third heater 28 is configured to cause the inks having been landed on the medium S to be completely dried and adhered onto the medium S at the latest before the winding of the medium S by the medium winding section 15 by heating up the medium S to a temperature higher than the target temperature to thereby cause not-yet-dried inks among the landed inks to be promptly dried.

The transport roller twin 21, serving as the transport section, is disposed between the platen 24 and the upstream side guide section 23, and transports the medium S in the transport direction (toward the +Y-axis side) while nipping the medium S. The transport roller twin 21 includes a transport driving roller 21*b* and a transport driven roller 21*a*. The transport driving roller 21*b* is disposed below the transport path and performs rotation driving. The transport driven roller 21*a* is disposed above the transport path and rotates by being driven by the rotation of the transport driving roller 21*b*. A transport motor (not illustrated) serving as a power source for outputting rotation power to the transport driving roller 21*b* is disposed inside the housing portion 51. The transport motor is driven and thereby the transport driving roller 21*b* performs rotation driving, thereby causing the medium S in a state of being nipped between the transport driven roller 21*a* and the transport driving roller 21*b* to be transported in the transport direction (toward the +Y-axis side).

Configuration of Printing Unit

The printing unit 50 is a unit for printing images, characters, and the like on the medium S in a state of being transported over the transport device 20. An operation panel 62 is disposed at an upper portion of the −X-axis side of the housing portion 51. The operation panel 62 includes a display section 64 and an operation section 63. The display section 64 is a section on which a printing condition setting screen and any other screen are displayed, and the operation section 63 is used when the inputs of printing conditions and any other piece of information and various instructions are received. An ink attachment section 65 is disposed at a lower position of the −X-axis direction side of the housing portion 51. The ink attachment section 65 is a section to which unillustrated ink containers (ink cartridges) capable of containing inks therein are attachable. A plurality of ink cartridges are attached to the ink attachment section 65 in response to the kinds and colors of inks. Moreover, a controller 66 is disposed inside the housing portion 51. The controller 66 controls the operations of devices provided at individual portions of the printing apparatus 10.

The printing section 58 is disposed inside the housing portion 51. At the rear side (−Y-axis side) of the housing portion 51, a feeding inlet 18 is formed at a position above the upstream side guide section 23. The feeding inlet 18 is an inlet through which the medium S is fed to the printing section 58. Further, at the front side (+Y-axis side) of the housing portion 51, a discharge outlet 19 is formed at a position above the downstream side guide section 25. The discharge outlet 19 is an outlet through which the medium S in a state of having been printed in the printing section 58 is discharged.

The printing section 58 is disposed at the upper side (+Z-axis side) relative to the position at which the platen 24 is disposed. The printing section 58 includes a discharge head 52, a carriage 55, a head shifting section 59, and any other section. The discharge head 52 discharge the inks onto the medium S in a state of having been fed from the medium feeding section 14 and being transported along the upstream side guide section 23 and the platen 24. The carriage 55 includes the discharge head 52 mounted therein. The head shifting section 59 shifts the carriage 55 in a main-scanning direction intersecting with the transport direction (i.e., in the X-axis direction).

The head shifting section 59 shifts the carriage 55 (the discharge head 52) in the main-scanning direction. Further, guide rails 56 and 57 are disposed along the X-axis direction, and the carriage 55 is supported by these guide rails 56 and 57. The carriage 55 is configured to be reciprocatable by the head shifting section 59 toward each of the ±X-axis sides. As a mechanism for the head shifting section 59, any appropriate mechanism, such as a mechanism constituted by combinations of a ball screw and a ball nut, or a linear guide mechanism, may be employed. Moreover, in the head shifting section 59, a motor (not illustrated) is disposed as a power source for shifting the carriage 55 along the X-axis direction. The motor is driven by the control of the controller 66, thereby causing the discharge head 52 to reciprocate along the X-axis direction together with the carriage 55.

An adjustment mechanism 53 is disposed at both edge portions of the guide rails 56 and 57 in the X-axis direction. The adjustment mechanism 53 is a mechanism for changing the height of the discharge head 52 (i.e., a position in the Z-axis direction) to allow a gap distance between the discharge head 52 and the medium S to be adjusted. Further, at a lower portion of the carriage 55, reflection type sensors 54 are held at positions on the downstream side (+Y-axis side) of the discharge head 52 in the transport direction. The reflection type sensors 54 detect the paper width (the X-axis direction width) of the medium S.

The reflection type sensor 54 is an optical sensor including a light source and alight reception portion, which are not illustrated. The reflection type sensor 54 receives reflected light of light emitted downward from the light source portion, and outputs, to the controller 66, a detection value (a voltage value) equivalent to a magnitude of the reflected light received by the light reception portion. Further, the controller 66 allows the reflection type sensors 54 to perform the detection operation while allowing the carriage 55 to shift in the main-scanning direction so as to, based on the detection values, detect positions at which a reflection target changes, that is, both edge portions of the medium S in the X-axis direction, and thereby calculates the width (the X-axis direction length) of the medium S. Further, the discharge head 52 discharges the inks supplied from the ink containers onto the medium S along the transport path in accordance with the detected width of the medium S, thereby allowing printing to be performed. The medium S in a state of having been subjected to the printing is guided obliquely downwardly along the downstream side guide section 25, and is wound by the medium winding section 15.

It should be noted that, in the present embodiment, the configuration of the printing apparatus 10, that is, the configuration in which medium S of a long size is fed by means of the roll-to-roll method, has been described, but the invention is not limited to this configuration. For example, the printing apparatus may be configured to allow single sheets of paper each being cut to a predetermined length in advance to be fed by means of a sheet feeding method, or may be configured to allow the medium S in a state of having been subjected to printing to be discharged and stored in an unillustrated discharge basket that is attached instead of the medium winding section 15.

Further, in the present embodiment, as the discharge head 52, a serial head type discharge head mounted in the carriage 55, which reciprocates, and configured to discharge the inks while shifting in the width direction of the medium S (i.e., toward each of the ±X-axis sides) has been exemplified, but a line head type discharge head fixedly arranged and extending in the width direction of the medium S (i.e., in the X-axis direction) may be employed.

Cover and Storage Section

Figure 3:
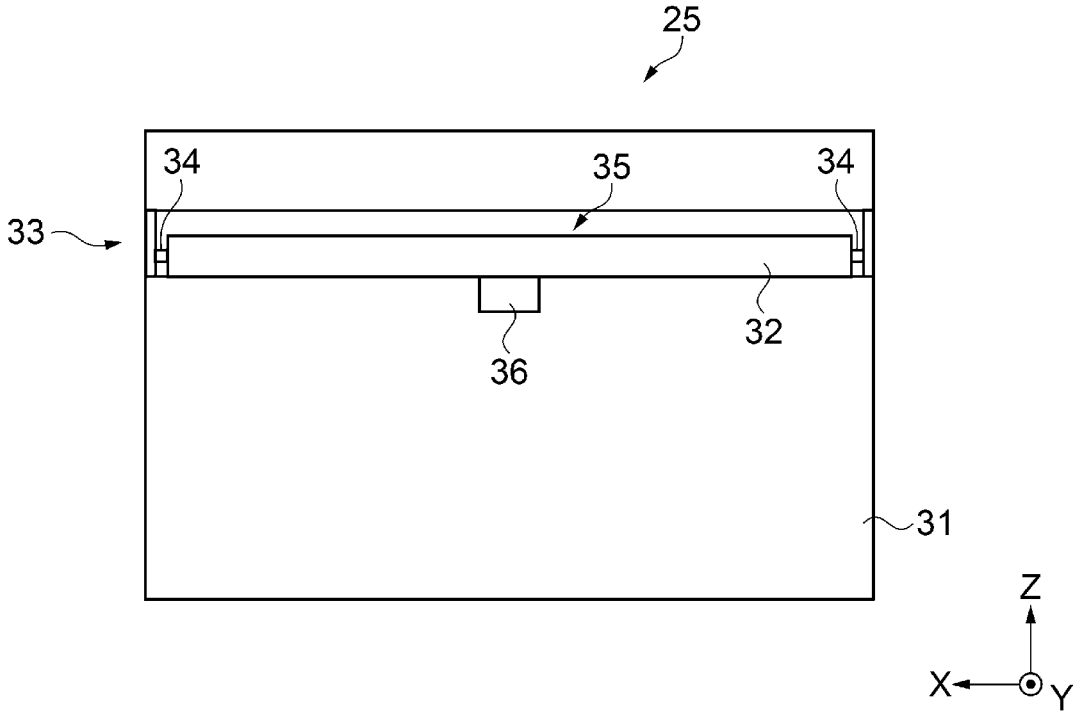
FIG. 3 is a plan view of a downstream side guide section illustrating a state in which a cover is stored therein.
Figure 4:
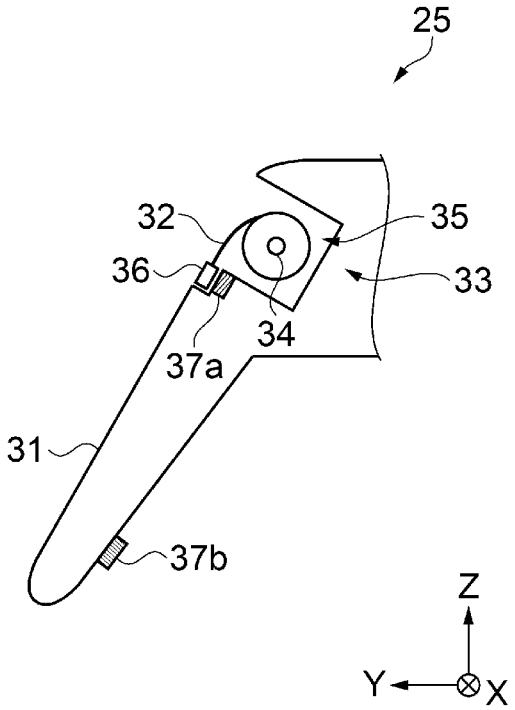
FIG. 4 is a cross-sectional view of the downstream side guide section illustrating the state, in which the cover is stored therein.
Figure 5:
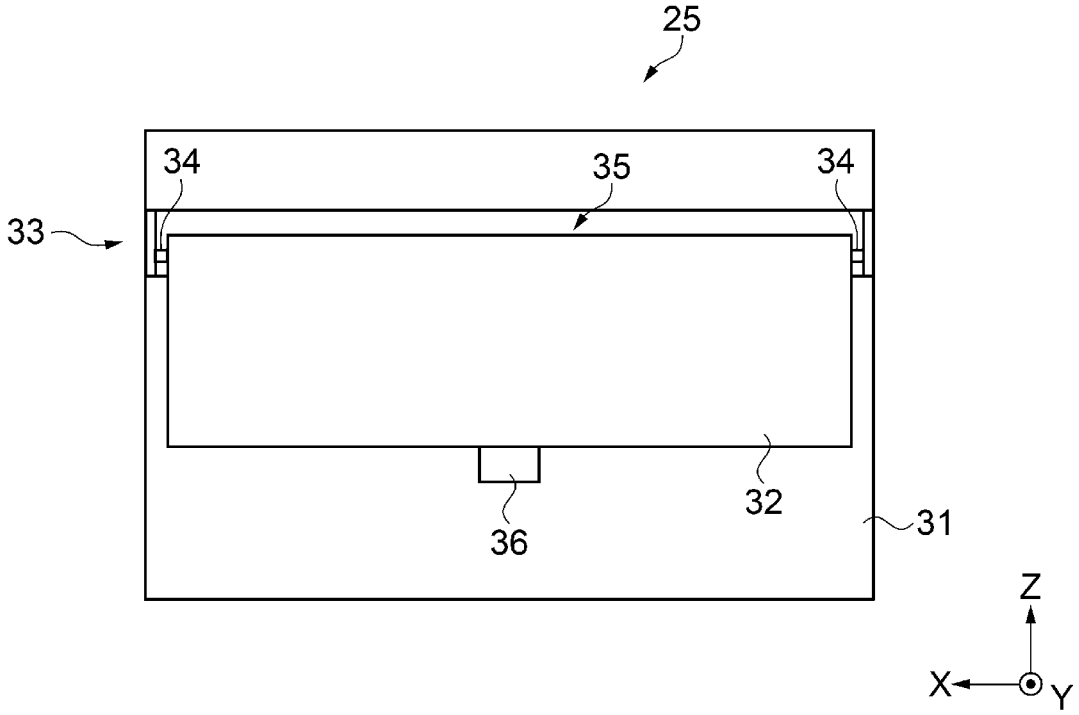
FIG. 5 is a plan view of the downstream side guide section illustrating a state in which a cover is in process of being attached.
Figure 6:
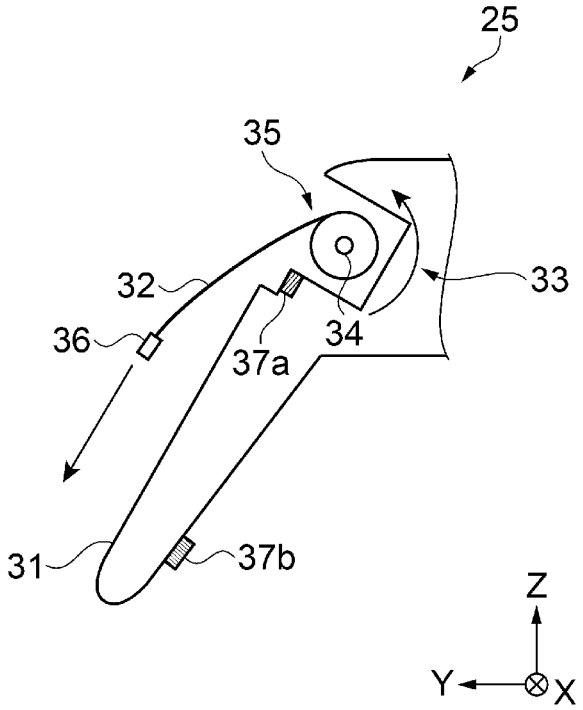
FIG. 6 is a cross-sectional view of the downstream side guide section illustrating the state, in which the cover is in process of being attached.
Figure 7:
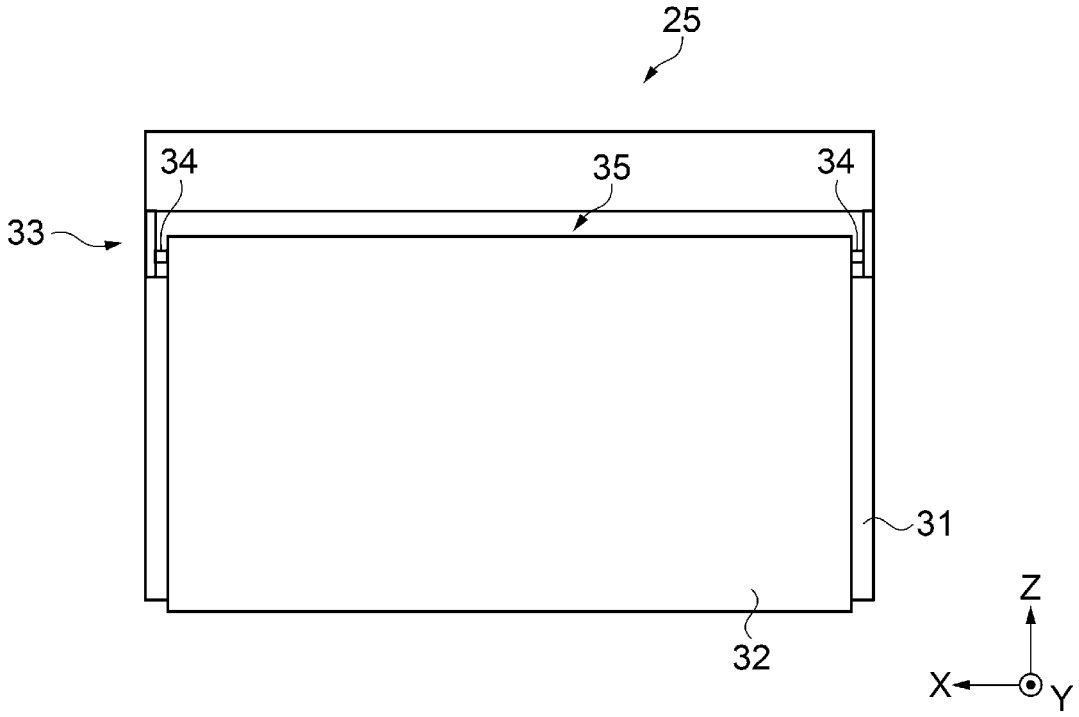
FIG. 7 is a plan view of the downstream side guide section illustrating a state in which a cover is attached.
Figure 8:
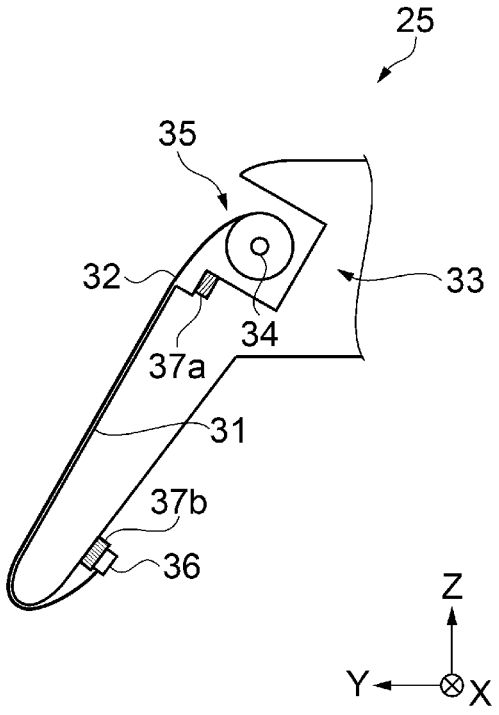
FIG. 8 is a cross-sectional view of the downstream side guide section illustrating the state, in which the cover is attached.
Figure 9:
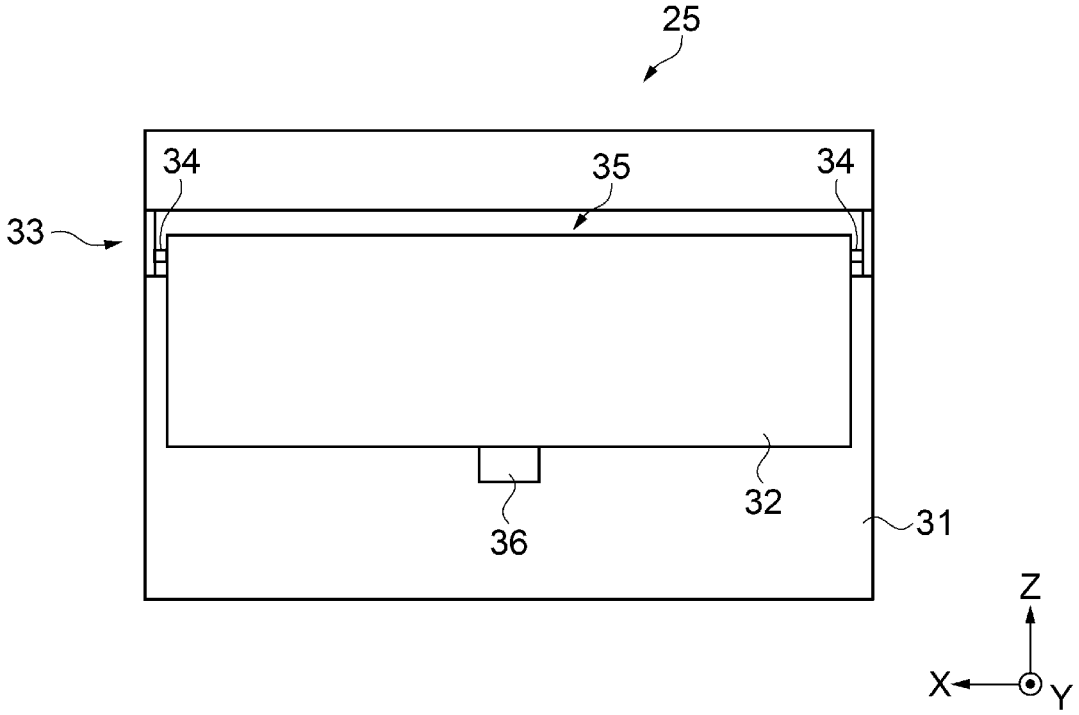
FIG. 9 is a plan view of the downstream side guide section illustrating a state in which a cover is in process of being stored.
Figure 10:
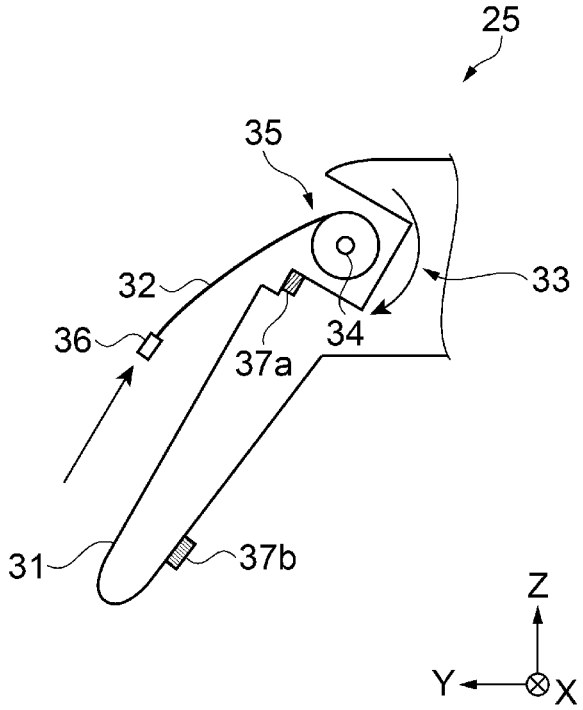
FIG. 10 is a cross-sectional view of the downstream side guide section illustrating the state, in which the cover is in process of being stored.

FIG. 3 is a plan view of the downstream side guide section 25 illustrating a state in which a cover 32 is stored therein, and FIG. 4 is a cross-sectional view of the downstream side guide section 25 illustrating the state, in which the cover 32 is stored therein. FIG. 5 is a plan view of the downstream side guide section 25 illustrating a state in which the cover 32 is in process of being attached, and FIG. 6 is a cross-sectional view of the downstream side guide section 25 illustrating the state, in which the cover 32 is in process of being attached. FIG. 7 is a plan view of the downstream side guide section 25 illustrating a state in which the cover 32 is attached, and FIG. 8 is a cross-sectional view of the downstream side guide section 25 illustrating the state, in which the cover 32 is attached. FIG. 9 is a plan view of the downstream side guide section 25 illustrating a state in which the cover 32 is in process of being stored, and FIG. 10 is a cross-sectional view of the downstream side guide section 25 illustrating the state, in which the cover 32 is in process of being stored.

The cover 32 and a storage section 33 are included in the downstream side guide section 25, and will be described below with reference to FIGS. 3 to 10.

First, the configuration of the cover 32 and the storage section 33 and a state in which the cover 32 is stored in the storage section 33 will be described.

As shown in FIGS. 3 and 4, the downstream side guide section 25 includes a guide face 31, that is, a guide face for guiding the medium S in the transport direction. The downstream side guide section 25 includes the cover 32 configured to be attached on the guide face 31, and the storage section 33 configured to allow the cover 32 in a state of being detached to be stored therein.

The cover 32 is formed of a reticulate resin material having a bending property, and forms a rectangular shape whose X-axis direction size is equal to or slightly larger than a maximum paper width (X-axis direction width) among the paper widths of the media S transportable by the transport device 20, and whose Y-axis direction size is longer than that of the guide face 31. The transport device 20 according to the present embodiment includes a static-electricity adhesion prevention cover as the cover 32. This static-electricity adhesion prevention cover prevents the adhesion of the medium S to the guide face 31 due to friction electric charges caused by an event in which the guide face 31 and the medium S in a state of being transported on the guide face 31 rub against each other. Known examples of the static-electricity adhesion prevention cover include, but are not limited to, TORICAL NET (trade mark) (model number: TORICAL NET N-9, material: high density polyethylene) manufactured by DAINIPPON PLASTICS CO., LTD.

The storage section 33 is disposed along the upstream edge side of the guide face 31. The storage section 33 forms a rectangular shape whose long side is longer than the X-axis direction width of the cover 32, and is buried in the downstream side guide section 25 so as to form a concave shape. The storage section 33 includes a winding section 35, and this winding section 35 includes a winding shaft 34. The cover 32 is lap-wound in a rolled shape around the winding shaft 34.

The winding shaft 34 is rotatably supported at both X-axis-direction inner walls of the storage section 33, formed in a concave shape. An unillustrated elastic member is secured to the winding shaft 34, and the winding shaft 34 is biased in the clockwise direction by the elastic member in a cross-sectional view from the −X-axis side shown in FIG. 4.

One edge side of the cover 32 along the X-axis direction is secured to the storage section 33. An engaging portion 36 is provided at the other edge side of the cover 32, and this engaging portion 36 allows the other edge side of the cover 32 to be engaged with a portion at a predetermined position. The engaging portion 36 may be configured using, for example, a magnet attachable/detachable to/from each of engaged members 37*a* and 37*b*. Here, these engaged members 37*a* and 37*b* are metallic members disposed at predetermined positions. In the present embodiment, the one edge side of the cover 32 is fixedly secured to the winding shaft 34.

When the cover 32 is in a state of being not used, the cover 32 is stored in the storage section 33 in a state of being wound around the winding shaft 34 by the elastic member. At this time, the engaging portion 36 is engaged with the engaged member 37*a* inside the storage section 33. With this configuration, even when the cover 32 is in a state being detached from the guide face 31 (i.e., in the state of being not used), the cover 32 is stored in the storage section 33 in a state in which the cover 32 and the transport device 20 are coupled to each other, and thus, the loss of the cover 32 is prevented. Note that the engaging portion 36 may be configured using, for example, a hook used by being hooked on an engaged member, such as a ring, disposed at a predetermined position.

The attachment of the cover 32 will be described below.

As shown in FIGS. 5 and 6, the wiring shaft 34 is extended in a direction intersecting with the transport direction of the medium S (i.e., in the X-axis direction). When attaching the cover 32 on the guide face 31, a user releases the engagement of the engaging portion 36 with the engaged member 37*a*, and draws the cover 32 obliquely downwardly (toward the −Z-axis side) along the guide face 31 toward the front side (toward the +Y-axis side) while grasping the engaging portion 36. With this operation, the winding shaft 34 rotates in the counterclockwise direction in a side view from the −X-axis side, and the cover 32 in the state of being wound around the winding shaft 34 is drawn out. The winding shaft 34 is configured to extend in the X-axis direction, and thus, a user is able to easily draw out the cover 32 along the guide face 31.

As shown in FIGS. 7 and 8, a user draws out the cover 32 so as to allow the other edge side of the cover 32 to be extended beyond the front edge side of the guide face 31. The other edge side of the cover 32 is attachably and detachably engaged with a downstream side of the downstream side guide section 25 through the guide face 31. Specifically, a user turns around the other edge side of the drawn cover 32 from the front edge side of the downstream side guide section 25 toward the reverse face opposite the guide face 31 via the guide face 31, and engages the engaging portion 36 with the engaged member 37*b* disposed on the reverse face. At this time, the cover 32 is given the tensile force by the biasing force of the elastic member attached to the winding shaft 34.

The cover 32 has a bending property, and thus, is deformed so as to follow the surface shape of the guide face 31. The cover 32 is attached in a state of being closely adhered on the guide face 31 because of the bending property and the tensile force given to the cover 32. With this configuration, the medium S is transported in the transport direction in a favorable condition. Further, the engaging portion 36 is attachably and detachably engaged with the engaged member 37*b*, and thus, the attachment and detachment of the cover 32 are facilitated. Note that, in the present embodiment, the configuration in which the engaged portion 37*b* is disposed on the reverse face of the downstream side guide section 25 has been described, but any configuration that allows an engaged member to be disposed at a position where the transport of the medium S is not blocked is acceptable. Further, the downstream side guide section 25 may be configured by a metallic material that allows the entire downstream side guide section 25 to be formed as an engaged member.

The detachment of the cover 32 will be described below.

As shown in FIGS. 9 and 10, when detaching the cover 32, a user releases the engagement of the engaging portion 36 in a state of being engaged with the engaged portion 37*b*. The cover 32 allows the winding shaft 34 to be rotated by the biasing force of the elastic member attached to the winding shaft 34 in the clockwise direction in a side view from the −X-axis side. With this rotation of the winding shaft 34, the cover 32 is wound around the winding shaft 34, and is stored in the storage section 33. At this time, the engaging portion 36 moves together with the cover 32, and is engaged with the engaged portion 37*a* inside the storage section 33. A user is able to easily detach and store the cover 32 into the storage section 33 because of the existence of both of the winding shaft 34 disposed so as to extend in the direction intersecting with the transport direction of the medium S, and the biasing force of the elastic member attached to the winding shaft 34.

Note that, in the present embodiment, the configuration in which the cover 32 is wound around the winding shaft 34 by the biasing force of the elastic member attached to the winding shaft 34 has been described, but a configuration that allows the cover 32 to be drawn from the winding shaft 34 and be wound around the winding shaft 34 by a motor serving as a power source that allows the winding shaft 34 to rotate forwardly/backwardly may be employed.

Further, in the present embodiment, the static-electricity adhesion prevention cover has been exemplified as the cover 32, but the invention is not limited to this configuration. The cover 32 may be an ink absorption cover, such as nonwoven cloth, that prevents inks from penetrating to the reverse face of the medium S and being adhered to the guide face 31.

Further, in the present embodiment, the configuration in which the cover 32 and the storage section 33 are disposed in the downstream side guide section 25 has been described, but the invention is not limited to this configuration. A configuration that allows a cover and a storage portion to be disposed in the upper side guide section 23 or the platen 24 may be employed.

As described above, the transport device 20 and the printing apparatus 10 according to the present embodiment brings about advantages described below.

The transport device 20 according to the present embodiment includes, in the downstream side guide section 25, the cover 32, which is configured to be attached on the guide face 31 for guiding the medium S in the transport direction, and the storage section 33, which is configured to store therein the cover 32 in a state of being detached. One edge side of the cover 32 is secured to the storage section 33. With this configuration, even when the cover 32 is in a state being detached from the guide face 31, the cover 32 is stored in the storage section 33 in a state in which the cover 32 is coupled to the device apparatus 20 through the storage section 33, and thus, the loss of the cover 32 is prevented. Accordingly, it is achieved to provide the transport apparatus 20 configured to prevent the loss of the cover 32.

The storage section 33 is disposed along the upstream edge side of the guide face 31. One edge side of the cover 32 is secured to the storage section 33, and the other edge side of the cover 32 is attachably and detachably engaged with a downstream side of the downstream side guide section 25 through the guide face 31. Thus, a use is able to easily attach/detach the cover 32 onto/from the guide face 31.

The cover 32 has a bending property, and thus is deformed so as to follow the surface shape of the guide face 31. With this configuration, when the cover 32 is attached on the guide face 31, the cover 32 is closely adhered on the guide face 31, and thus, the transport device 20 transports the medium S in a favorable condition.

The storage section 33 includes the winding section 35, which is provided with the winding shaft 34 around which the cover 32 is lap-wound in a rolled shape. Further, the wiring shaft 34 is configured to extend in the direction intersecting with the transport direction of the medium S. With this configuration, a user is able to easily draw out the cover 32 in a state of being stored in the storage section 33 from the storage section 33, and easily store the cover 32 in a state of being attached on the guide face 31 into the storage section 33.

The printing apparatus 10 according to the present embodiment includes the transport device 20 configured to prevent the loss of the cover 32. Accordingly, it is achieved to provide the printing apparatus 10 configured to prevent the loss of the cover 32 is achieved.

This application claims priority under 35 U.S.C. § 119 to Japanese Patent Application No. 2016-166549, filed Aug. 29 2016. The entire disclosure of Japanese Patent Application No. 2016-166549 is hereby incorporated herein by reference.

What is claimed is:

1. A transport device comprising:

a transport section configured to transport a medium;

a medium guide section including a guide face for guiding, in a transport direction, the medium in a state of being transported by the transport section;

a cover configured to be attached on the guide face; and a storage section configured to store in itself the cover in a state of being detached, wherein one edge side of the cover is secured to the storage section, and wherein the storage section is disposed along an upstream edge side of the guide face, and another edge side of the cover is configured to be attachably and detachably engaged with a downstream side of the medium guide section through the guide face.

2. The transport device according to claim 1, wherein the cover includes a bending property, and is deformed so as to follow a surface shape of the guide face.

3. The transport device according to claim 1, wherein the storage section includes a winding portion including a winding shaft around which the cover is wound.

4. The transport device according to claim 3, wherein the winding shaft is configured to extend in a direction intersecting with the transport direction.

5. A printing apparatus comprising the transport device according to claim 1.

6. A printing apparatus comprising the transport device according to claim 2.

7. A printing apparatus comprising the transport device according to claim 3.

8. A printing apparatus comprising the transport device according to claim 4.

* * * * *